US009477194B2

(12) United States Patent
Adachi

(10) Patent No.: US 9,477,194 B2
(45) Date of Patent: Oct. 25, 2016

(54) IMAGE FORMING APPARATUS CAPABLE OF LIMITING RANGE OF OPERATION DURING MAINTENANCE, CONTROL METHOD THEREFOR, AND STORAGE MEDIUM

(71) Applicant: CANON KABUSHIKI KAISHA, Tokyo (JP)

(72) Inventor: Tomoko Adachi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/603,462

(22) Filed: Jan. 23, 2015

(65) Prior Publication Data

US 2015/0212468 A1 Jul. 30, 2015

(30) Foreign Application Priority Data

Jan. 27, 2014 (JP) ..... 2014-012534

(51) Int. Cl.
*G03G 15/00* (2006.01)
*G03G 21/00* (2006.01)

(52) U.S. Cl.
CPC ..... *G03G 15/5091* (2013.01)

(58) Field of Classification Search
CPC ..... G03G 15/5079; G03G 15/5091
USPC ..... 399/11, 80, 81
See application file for complete search history.

(56) References Cited

U.S. PATENT DOCUMENTS 5,999,766 A * 12/1999 Hisatomi et al. .. H04N 1/00912 399/80
6,327,446 B1 * 12/2001 Suzuki ..... G03G 15/5075 399/11
6,768,877 B2 * 7/2004 Alegria et al. ..... G03G 15/502 399/80
7,343,114 B2 * 3/2008 Uruta ..... G03G 15/50 399/80

FOREIGN PATENT DOCUMENTS

JP 2011123898 A 6/2011

* cited by examiner

*Primary Examiner* — William J Royer
(74) *Attorney, Agent, or Firm* — Rossi, Kimms & McDowell LLP

(57) ABSTRACT

An image forming apparatus for preventing unauthorized manipulations of maintenance setting items by a service person includes a plurality of setting items having setting values changed by the maintenance work is stored in an HDD. A maintenance authentication unit performs authentication of the service person who performs the maintenance work. A restricting unit restricts change of the setting values by an authenticated service person. A user authentication unit performs authentication of a user who uses the image forming apparatus. When change of the setting values by the service person is restricted, a display control unit controls display of the plurality of setting items on a basis of whether or not the service person has been authenticated by the user authentication unit.

30 Claims, 11 Drawing Sheets

*FIG. 5*

| 501 NO | 502 ITEM NAME | 503 ITEMS TO BE LOGGED | 504 RECOVERY ITEM | |
|---|---|---|---|---|
| 001 | DELETION OF SYSTEM ADMINISTRATOR'S PW | ○ | ○ | 510 |
| 002 | DELETION OF APPLICATION CACHE | × | ○ | 511 |
| 003 | INITIALIZATION OF SETTING VALUES | ○ | ○ | 512 |
| ⋮ | ⋮ | ⋮ | ⋮ | |
| 020 | SETTING OF SHEET TRAY SIZE | × | — | 513 |
| 021 | CLEARING OF SERVICE COUNTER | ○ | ○ | 514 |
| 022 | IMAGE ADJUSTMENT | ○ | — | 515 |
| ⋮ | ⋮ | ⋮ | ⋮ | |

*FIG. 6*

| 801 SETTING OF RESTRICTION ON OPERATION BY SERVICE PERSON | 802 SETTING VALUE | 803 RANGE OF OPERATION BY SERVICE PERSON FOR USER RESOURCE INFORMATION 402 | |
|---|---|---|---|
| ON (DISABLE) | 1 | ONLY REFERENCE | 811 |
| OFF (ENABLE) | 0 | REFERENCE/CHANGING OF OPERATION ENABLED | 812 |
| OFF (AUTHENTICATION REQUIRED) | 2 | REFERENCE/CHANGING OF OPERATION ENABLED WHEN AUTHENTICATION IS OK | 813 |

*FIG. 7*
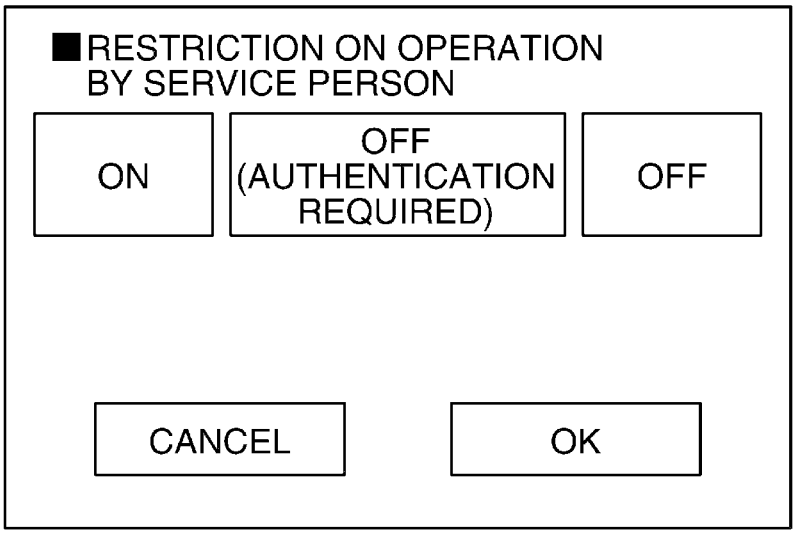
*FIG. 8*
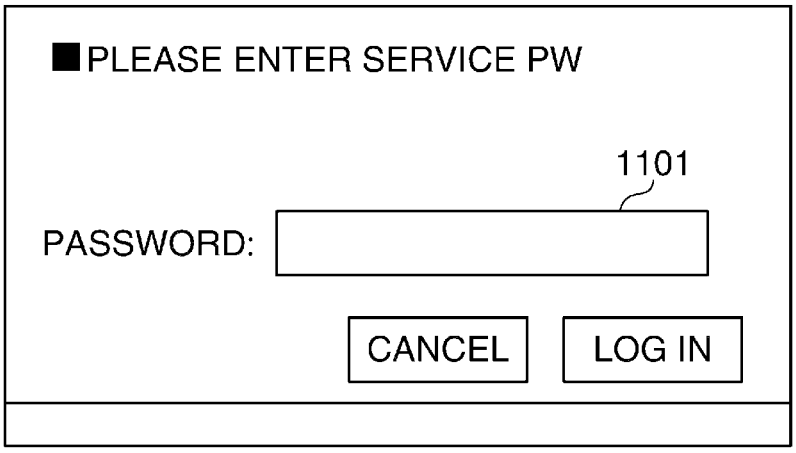
*FIG. 9*
| PASSWORD |
| --- |
| 09876 |

| 701 USER NAME (ID) | 702 PASSWORD | 703 AUTHORITY (ROLE) |
|---|---|---|
| A | 1234 | Administrator |
| B | 5678 | General |
| C | 9876 | Guest |
| D | 5432 | General |

FIG. 12

| 901 USER NAME (ID) | 902 MAINTENANCE LOGIN AUTHENTICATION RESULT | 903 AUTHORITY (ROLE) | 904 AUTHORITY TO MANIPULATE USER RESOURCE INFORMATION 402 |
|---|---|---|---|
| A | NG | Administrator | × |
| B | NG | General | × |
| C | OK | Guest | × |
| D | OK | General | ○ |
| E | OK | Administrator | ○ |

FIG. 13

| 1001 USER NAME (ID) | INFORMATION ON MANIPULATION OF USER RESOURCE INFORMATION 402 | 1003 DATE AND TIME OF OPERATION |
|---|---|---|
| D | 003 | 2013-1001-1518 |
| A | 010 | 2013-1015-1823 |

IMAGE FORMING APPARATUS CAPABLE OF LIMITING RANGE OF OPERATION DURING MAINTENANCE, CONTROL METHOD THEREFOR, AND STORAGE MEDIUM

BACKGROUND OF THE INVENTION

1. Field of the Invention

The present invention relates to an image forming apparatus, and in particular to an image forming apparatus and a control method therefor which are capable of limiting the range of operations that can be performed by a service person during maintenance, as well as a storage medium.

2. Description of the Related Art

An image forming apparatus usually has an image processing application for performing an image reading function, a printing function, a communication function, and the like. A service person (skilled person) visits a customer to perform maintenance of the image forming apparatus.

The image forming apparatus has a large number of setting items, and the service person corrects malfunctions of the image forming apparatus and adjusts motion of the image forming apparatus by referring to setting values of multiple maintenance setting items required for maintenance work among the large number of setting items and changing the setting values of the maintenance setting items.

Information on the plurality of maintenance setting items is divided broadly into two; one is, for example, maintenance information such as image adjustment values, license values, and screen display settings which are used by a manufacturer in maintenance, and the other is, for example, user resource information such as history information on HDD clearing and network-related setting values. The maintenance information and the user resource information are required to be managed while being monitored by a manufacturer and a user, respectively.

As for management of the user resource information, there has been known a technique to, at the time of using an image forming apparatus, perform user authentication and check user authorities using a user management function contained in the image forming apparatus, and based on the checking result, restrict use of the image forming apparatus (see, for example, Japanese Laid-Open Patent Publication (Kokai) No. 2011-123898).

However, the conventional user authentication technique for maintenance work is not good enough in terms of restrictions on manipulations of maintenance setting items by a service person. For example, in an image forming apparatus of a user who has a maintenance contract, a service person is allowed to manipulate the user resource information mentioned above, and usually, the service person performs maintenance work so that the user can use the image forming apparatus in a more comfortable manner. However, there may be cases where a malicious person pretends to be a service person and manipulates user resource information without user's intent, and as a result, the security of the image forming apparatus could not be maintained.

SUMMARY OF THE INVENTION

The present invention provides an image forming apparatus and a control method therefor which are capable of preventing unauthorized manipulations of maintenance setting items by a service person, as well as a storage medium.

Accordingly, a first aspect of the present invention provides an image forming apparatus comprising a setting item storage unit configured to store a plurality of setting items having setting values that are changed by maintenance work on the image forming apparatus, a maintenance authentication unit configured to authenticate a maintenance worker who performs the maintenance work on the image forming apparatus, a restricting unit configured to restrict change of the setting values by the authenticated maintenance worker, a user authentication unit configured to authenticate a user who uses the image forming apparatus, and a display control unit configured to, when the restricting unit restricts change of the setting values by the maintenance worker, control display of the plurality of setting items on a basis of whether or not the maintenance worker has been authenticated by the user authentication unit.

Accordingly, a second aspect of the present invention provides a control method for an image forming apparatus, comprising a setting item storage step of storing a plurality of setting items having setting values that are changed by maintenance work on the image forming apparatus, a maintenance authentication step of authenticating a maintenance worker who performs the maintenance work on the image forming apparatus, a restricting step of restricting change of the setting values by the authenticated maintenance worker, a user authentication step of authenticating a user who uses the image forming apparatus, and a display control step of, when change of the setting values by the maintenance worker is restricted in the restricting step, controlling display of the plurality of setting items on a basis of whether or not the maintenance worker has been authenticated in the user authentication step.

Accordingly, a third aspect of the present invention provides a non-transitory computer-readable storage medium storing a program for causing a computer to implement a control method for an image forming apparatus, the control method for the image forming apparatus comprising a setting item storage step of storing a plurality of setting items having setting values that are changed by maintenance work on the image forming apparatus, a maintenance authentication step of authenticating a maintenance worker who performs the maintenance work on the image forming apparatus, a restricting step of restricting change of the setting values by the authenticated maintenance worker, a user authentication step of authenticating a user who uses the image forming apparatus, and a display control step of, when change of the setting values by the maintenance worker is restricted in the restricting step, controlling display of the plurality of setting items on a basis of whether or not the maintenance worker has been authenticated in the user authentication step.

According to the present invention, restrictions on operations by a service person in maintenance work are set in advance for respective maintenance setting items, and when the service person is not allowed to normally log in, he or she is notified that it is impossible to change setting values of maintenance setting items on which operational restrictions are placed. This prevents unauthorized manipulations of maintenance setting items by a service person.

Further features of the present invention will become apparent from the following description of exemplary embodiments (with reference to the attached drawings).

BRIEF DESCRIPTION OF THE DRAWINGS

FIG. 5 is a diagram showing user resource information and maintenance information in FIG. 4.

FIG. 6 is a diagram showing information on settings as to restrictions on operations by a service person, which is displayed on an operating unit of the image forming apparatus in FIG. 2.

FIG. 7 is a view showing a setting screen for setting restrictions on operations by a service person, which is displayed on the operating unit of the image forming apparatus in FIG. 2.

FIG. 8 is a view showing a service person authentication screen that is displayed on the operating unit of the image forming apparatus in FIG. 2.

FIG. 9 is a diagram showing service person password data that is used by a maintenance login authentication module in FIG. 3.

FIG. 12 is a diagram showing a setting value change enable-disable determination result that is managed by an authentication management module in FIG. 3.

FIG. 13 is a diagram showing operation record data that is managed by a log management module in FIG. 3.

DESCRIPTION OF THE EMBODIMENTS

The present invention will now be described in detail with reference to the drawings showing an embodiment thereof.

Figure 1:
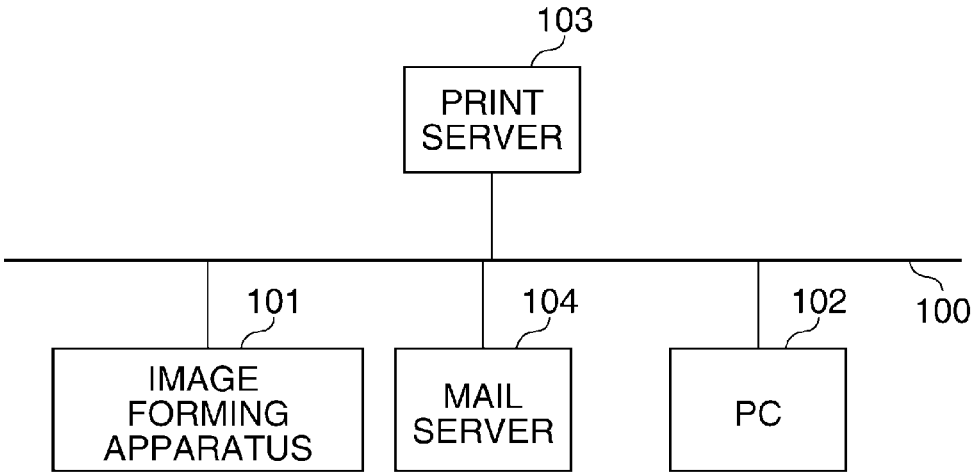
FIG. 1 is a block diagram schematically showing an arrangement of an image forming system including an image forming apparatus according to an embodiment of the present invention.

FIG. 1 is a block diagram schematically showing an arrangement of an image forming system including an image forming apparatus 101 according to an embodiment of the present invention.

The image forming system in FIG. 1 is comprised of the image forming apparatus 101, a PC 102, a print server 103, and a mail server 104, which are connected to one another via a LAN 100.

The image forming apparatus 101 performs printing of a print job transmitted from the PC 102 or a print job transmitted from the print server 103 as a result of access to the print server 103. The image forming apparatus 101 transmits scanned image data to the PC 102 via the mail server 104.

Figure 2:
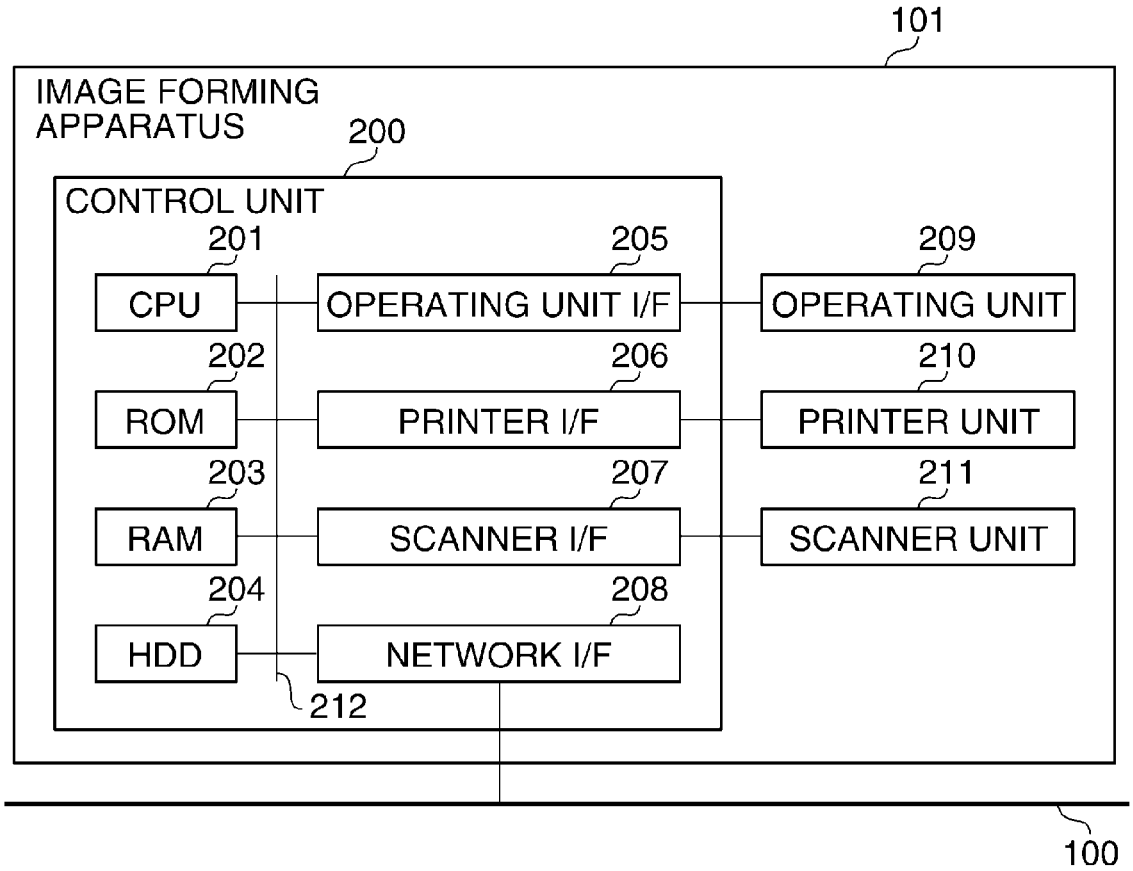
FIG. 2 is a block diagram schematically showing a hardware arrangement of the image forming apparatus in FIG. 1.

FIG. 2 is a block diagram schematically showing a hardware arrangement of the image forming apparatus 101 in FIG. 1.

The image forming apparatus 101 has a control unit 200, an operating unit 209, a printer unit 210, and a scanner unit 211.

The control unit 200 has a CPU 201, a ROM 202, a RAM 203, an HDD 204, an operating unit I/F 205, a printer I/F 206, a scanner I/F 207, and a network I/F 208, which are connected to one another via a bus 212.

The operating unit 209 is connected to the operating unit I/F 205, the printer unit 210 is connected to the printer I/F 206, the scanner unit 211 is connected to the scanner I/F 207, and the LAN 100 is connected to the network I/F 208.

The CPU 201 reads out control programs stored in the ROM 202 to provide various types of control such as reading control and transmission control. The RAM 203 is used as a temporary storage area such as a main memory or a work area for the CPU 201. The HDD 204 stores image data and various programs.

The operating unit 209 displays a display screen for performing login authentication of a user, and displays descriptions of operations required for maintenance work by a service person (maintenance worker) and setting values for the operations on a display screen.

The printer unit 210 prints image data, which is transferred from the control unit 200 via the printer I/F 206, on a recording medium.

The scanner unit 211 reads an image off an original to generate image data and sends the image data to the control unit 200 via the scanner I/F 207.

Figure 3:
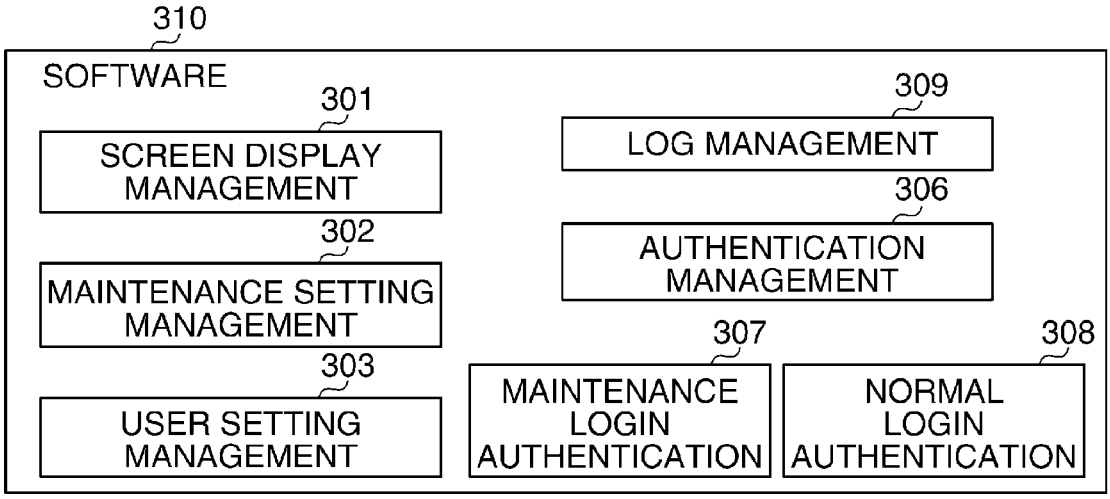
FIG. 3 is a diagram useful in explaining a software arrangement of the image forming apparatus in FIG. 2.

FIG. 3 is a diagram useful in explaining an arrangement of software 310 of the image forming apparatus 101 in FIG. 2.

The software 310 of the image forming apparatus 101 is comprised of a screen display management module 301, a maintenance setting management module 302, a user setting management module 303, a log management module 309, an authentication management module 306, a maintenance login authentication module 307, and a normal login authentication module 308. The software 310 is stored in the ROM 202 or the HDD 204 of the image forming apparatus 101.

The screen display management module 301 displays a service person authentication screen for performing login authentication of the service person in maintenance work, or a display screen which is a UI (user interface) such as a login authentication screen in normal user authentication on the operating unit 209. When the service person is authenticated and authorized to log in by the maintenance login authentication module 307, the screen display management module 301 displays a service person maintenance screen, and when a device administrator who is a user makes a setting as to whether or not to allow the service person to manipulate user resource information, the screen display management module 301 displays a setting screen to restrict operations of the service person.

Figure 4:
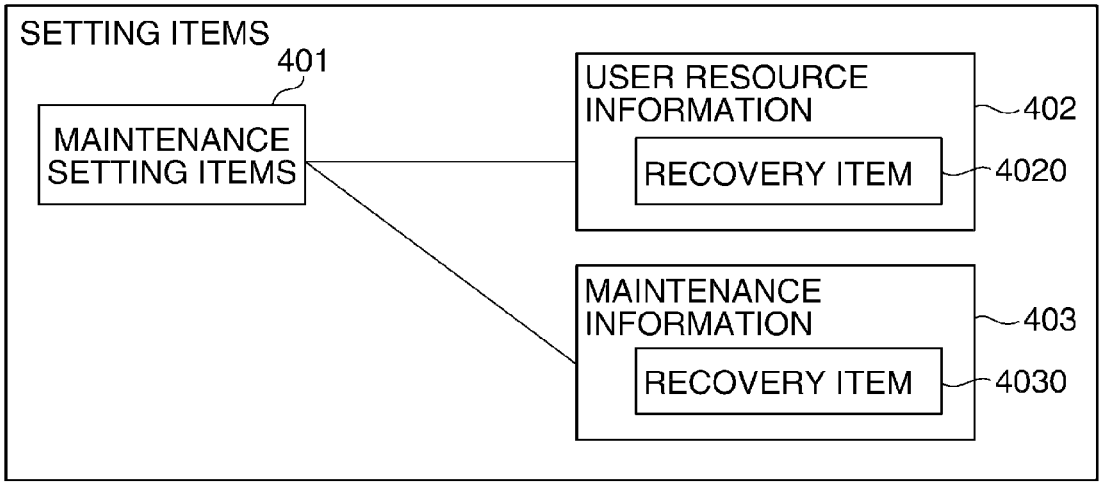
FIG. 4 is a diagram useful in explaining maintenance setting items for a maintenance setting management module in FIG. 3.

The maintenance setting management module 302 (identifying unit) manages maintenance setting items 401 (FIG. 4) required for maintenance work. The maintenance setting items 401 in FIG. 4 are comprised of user resource information 402 and maintenance information 403 required for maintenance work by a manufacturer. The user resource information 402 and the maintenance information 403 have respective recovery items (4020 and 4030) required for troubleshooting when an error occurs in the image forming apparatus 101.

Referring to FIG. 5, the user resource information 402 and the maintenance information 403 of the maintenance setting items 401 are comprised of "Nos." 501, "item names" 502 in which descriptions of operations are written, "items to be logged" 503, and "recovery items" 504 indicating whether or not operation is required for troubleshooting when an error occurs in the image forming apparatus 101, and they are stored in the HDD 204 (setting item storage unit). Item groups 510 to 512 relating to respective Nos. 001 to 003 correspond to the user resource information 402, and item groups 513 to 515 relating to respective Nos. 020 to 022, correspond to the maintenance information 403.

In the maintenance setting items 401, "Nos." 501 are assigned to the respective "item names 502", and the "items to be logged" 503 indicate whether or not to keep operation record data (see FIG. 13, to be referred to later) for the "item names" 502. In the present embodiment, only operation record data corresponding to the "item names" 502 for which the "items to be logged" 503 are "o" is kept.

Descriptions of operations written in the "item names" 502 for which the "recovery items" 504 are "o" are displayed on a maintenance operation screen in a case where an error occurs in the image forming apparatus 101 even when the user (device administrator) restricts operations by the service person, and the operations are allowed to be performed by the service person and correspond to operations of the recovery items (4020 and 4030).

Descriptions of operations written in the "item names" 502 for which the "recovery items" 504 are "-" are displayed on the maintenance operations screen even when an error occurs in the image forming apparatus 101, but the operations are not allowed to be performed by the service person. Namely, operations of which descriptions are written in the "item names" 502 for which the "recovery items" 504 are "o" are operations for which recovery is difficult when an error occurs in the image forming apparatus 101 unless they are performed when the image forming apparatus 101 is in an emergency state.

The user setting management module 303 is managed by the device administrator and manages information about settings as to restrictions on operations by the service person for the user resource information 402 (FIG. 6). By properly setting restrictions on operation by the service person using a setting screen (FIG. 7) for setting restrictions on operations by the service person, the device administrator can limit the range of operation by the service person for the user resource information 402.

As shown in FIG. 6, information 811 to 813 about settings as to restrictions on operations by the service person is comprised of "service person operation restriction settings" 801, "setting values" 802 for the "service person operation restriction settings" 801, and "service person operation range for user resource information 402" 803 and stored in the HDD 204.

The maintenance login authentication module 307 performs authentication of the service person using a service person authentication screen (FIG. 8), which is displayed on the operating unit 209 via the screen display management module 301, so as to determine whether or not the service person is allowed to access the maintenance setting management module 302. The maintenance login authentication module 307 performs authentication by comparing input data which the service person has entered in a "password" field 1101 on the service person authentication screen (FIG. 8) displayed on the operating unit 209 with service person password data (FIG. 9) stored in advance in the HDD 204.

The normal login authentication module 308 performs user authentication by displaying a login authentication screen (FIG. 10) on the operating unit 209 via the screen display management module 301 before the user uses the image forming apparatus 101. The normal login authentication module 308 performs authentication by comparing input data which the user or service person has entered in a "user name" field 1201 or a "password" field 1202 on the login authentication screen (FIG. 10) displayed on the operating unit 209 with user data (FIG. 11) stored in advance in the HDD 204 and required for user authentication.

Figures 10, 11:
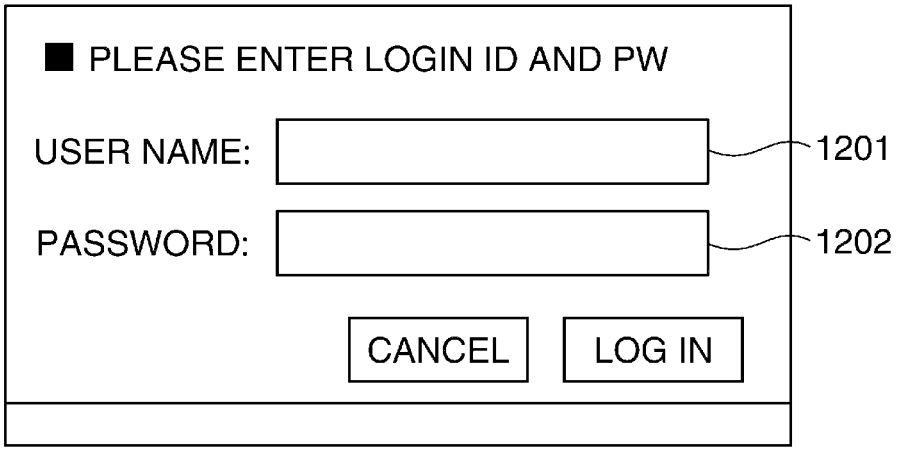
FIG. 10 is a view showing a login authentication screen that is displayed on the operating unit of the image forming apparatus in FIG. 2.
FIG. 11 is a diagram showing user data required for user authentication, which is used by a normal login authentication module in FIG. 3.

As shown in FIG. 11, user data required for user authentication is comprised of "user names (IDs)" 701, "passwords" 702, and "authorities (roles)" that limit the range of operation by each user for various functions of the image forming apparatus 101 and limits the range of operation for the maintenance setting items 401 of the image forming apparatus 101.

The "authorities (roles)" 703 include "Administrator", "General", and "Guest", and the degree of limitation on the range of operation increases in this order.

For example, at the time of making a user registration, the device administrator configures settings on the "authorities (roles)" 703. There may be cases where the role "Guest" is assigned to a user who has not made a user registration by the device administrator, and hence "Guest" cannot be given the right to manipulate the user resource information 402. On the other hand, sometimes the service person performs operations allowed for only the device administrator, and hence the service person should be given the role "Administrator" or "General" corresponding to the role of the device administrator.

In the following description of the present embodiment, it is assumed that the service person is given the role "Administrator" or "General" who is allowed to manipulate the user resource information 402.

Based on results of authentication performed by the maintenance login authentication module 307 and the normal login authentication module 308 and information on settings as to restrictions on operations by the service person for the user resource information 402 in combination, the authentication management module 306 determines whether or not the service person is allowed to change setting values of the user resource information 402 and stores, in the HDD 204, setting value change enable-disable determination results (FIG. 12) obtained as a result of the determination.

As shown in FIG. 12, the setting value change enable-disable determination results are comprised of "user names" 901, "maintenance login authentication results" 902, "authorities (roles)" 903, and "authorities to manipulate user resource information 402" 904 for users A to E. The setting value change enable-disable determination result shows that the service person is allowed to change setting values in the user resource information 402 with respect to only the user D and the user E for whom the "authorities to manipulate user resource information 402" 904 are "o".

The log management module 309 manages operation record data (FIG. 13) on the user resource information 402 and the maintenance information 403 for which the setting values have been changed by the service person. The operation record data is stored in the HDD 204.

As shown in FIG. 13, the operation record data is comprised of a "user name (ID)" 1001, a "description of manipulation on user resource information 402" corresponding to "No." 501 in the user resource information 402 and the maintenance information 403 (FIG. 5), and a "date and time of operation" 1003 with respect to each user. Since the device administrator is allowed to refer to the operation record data via the operating unit 209 or the like, he or she can manage who manipulated what during maintenance by the service person.

The operation record data in FIG. 13 shows that, for example, the user D has performed an operation "No. 003" on the user resource information 402 at 3:18 p.m. on Oct. 1, 2013.

Figure 14A:
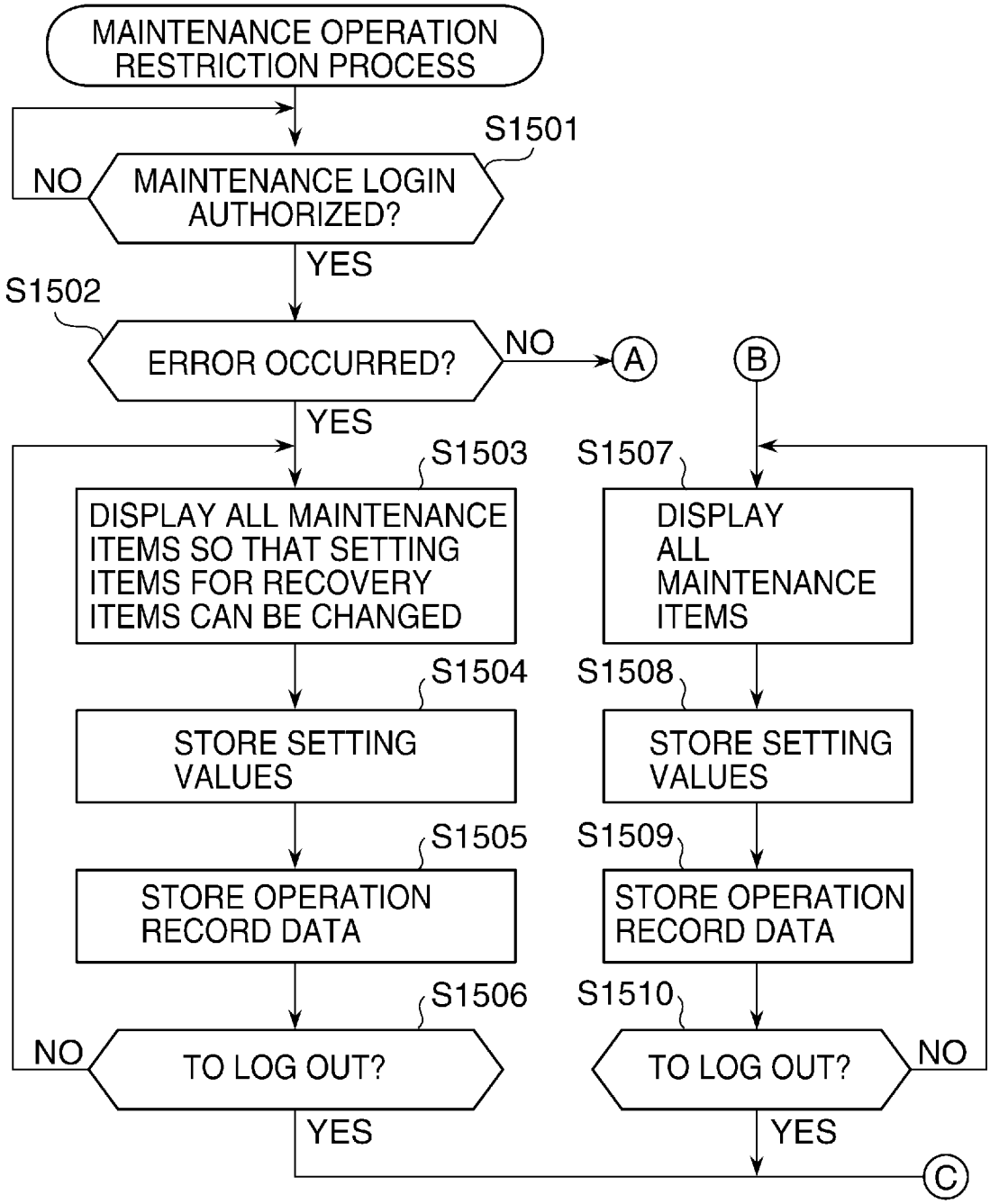
FIGS. 14A and 14B are flowcharts showing the procedure of a maintenance operation restricting process that is carried out by the image forming apparatus in FIG. 2.
Figure 14B:
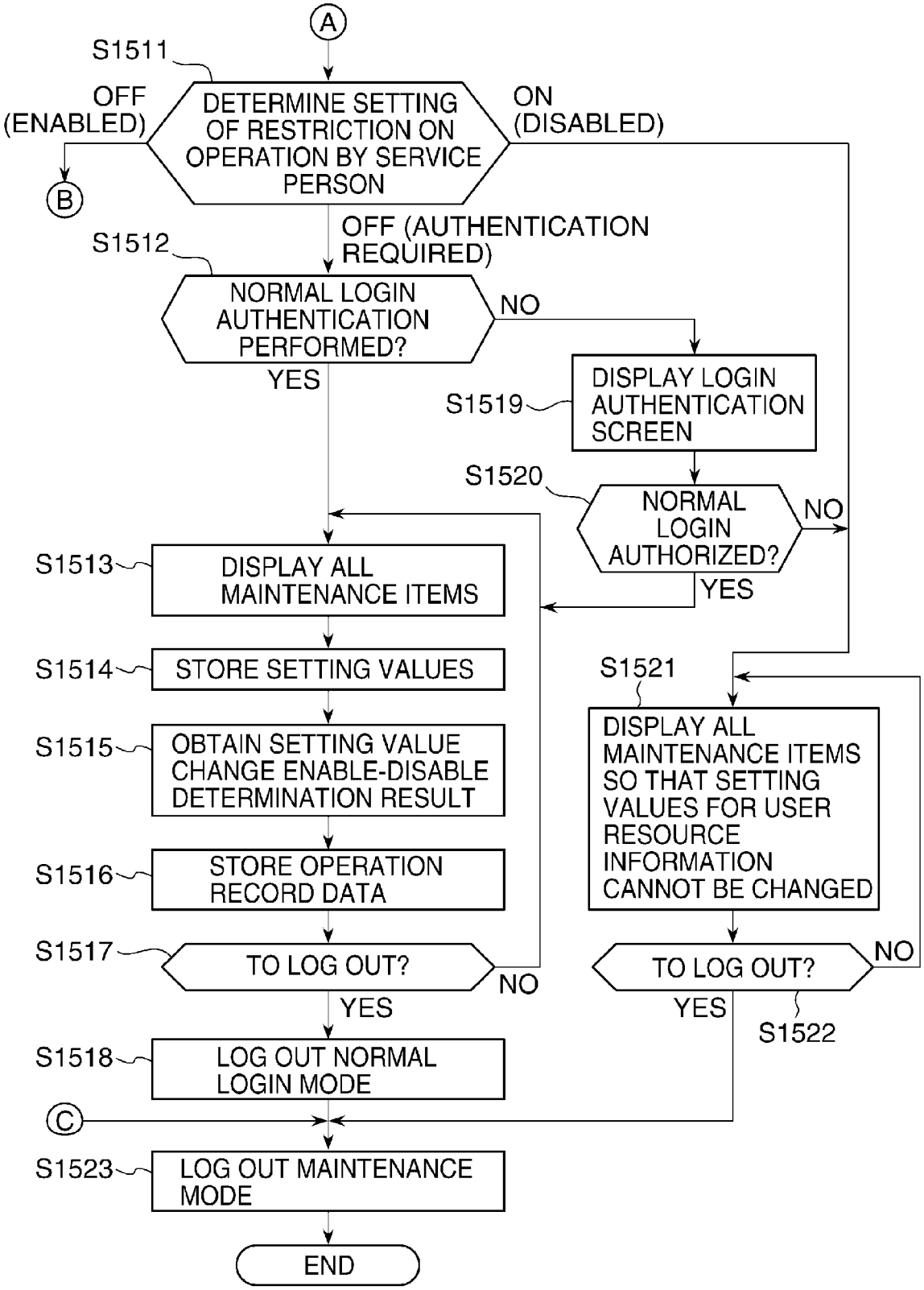

FIGS. 14A and 14B are flowcharts showing the procedure of a maintenance operation restricting process that is carried out by the image forming apparatus 101 in FIG. 2.

The maintenance operation restricting process in FIGS. 14A and 14B is carried out by the CPU 201 executing software stored in the ROM 202 or the HDD 204.

Referring to FIGS. 14A and 14B, first, the CPU 201 displays the service person authentication screen (FIG. 8) on the operating unit 209, and next, when the service person is authenticated and allowed to log in by the maintenance login authentication module 307 and logs into a maintenance mode (YES in step S1501) (maintenance authentication unit), the CPU 201 determines whether or not an error has occurred in the image forming apparatus 101 (step S1502) (determination unit).

As a result of the determination in the step S1502, when an error has occurred in the image forming apparatus 101, the CPU 201 displays maintenance settings 1310 to 1313 (setting items and setting values of the setting items), which correspond to all the maintenance setting items 401, on a maintenance screen 1300 (see FIG. 15, referred to later), and as for the maintenance settings 1310 and 1313 corresponding to the recovery items (4020 and 4030) required for recovery from the error among all the maintenance settings 1310 to 1313, displays OK buttons, which are depressed after setting values for operations are changed, on the maintenance screen 1300 (step S1503) (display control unit). This shows that for the maintenance settings 1310 and 1313 corresponding to the recovery items (4020 and 4030), setting values for operations are allowed to be changed.

Figure 15:
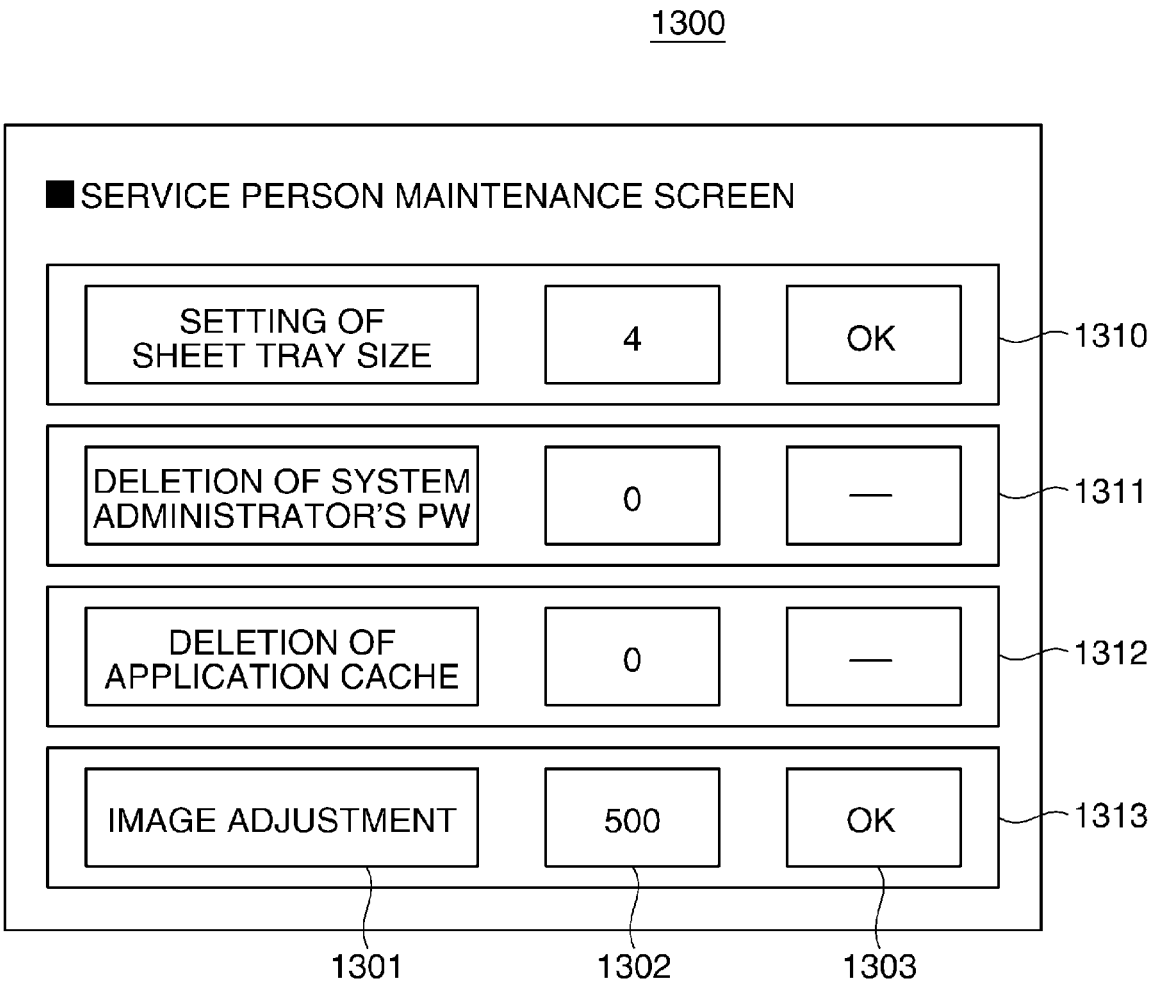
FIG. 15 is a diagram showing a service person maintenance screen that is displayed on the operating unit of the image forming apparatus in FIG. 2.

FIG. 15 is a diagram showing a service person maintenance screen that is operated by the service person during maintenance work. The maintenance screen 1300 is displayed on the operating unit 209 when the service person is authorized to log in by the maintenance login authentication module 307, and the maintenance screen 1300 shows the maintenance settings 1310 to 1313 corresponding to the respective maintenance setting items 401. As for the maintenance settings 1310 to 1313, the descriptions of operations written in the "item names" 502 in the user resource information 402 and the maintenance information 403 are displayed in display sections 1301, and setting values for the respective operations in the display sections 1301 are displayed in display sections 1302. In display sections 1303, the OK buttons mentioned above are displayed with respect to operations for which setting values are allowed to be changed, and "-" is displayed with respect to operations for which setting values are not allowed to be changed due to restrictions placed by the device administrator.

For example, in the step S1503, the OK buttons are displayed for the maintenance setting items 1310 and 1313 corresponding to the recovery items (4020 and 4030) required for recovery from the error since setting values thereof are allowed to be changed. On the other hand, for the maintenance setting items 1311 and 1312 that do not correspond to the recovery items (4020 and 4030), "-" is displayed since setting values thereof are not allowed to be changed.

Then, the CPU 201 stores setting values for the operations in the respective recovery items (4020 and 4030) changed using the display sections 1302 in the HDD 204 (step S1504), stores operation record data (FIG. 13) created based on information on the stored setting values that have been changed in the HDD 204 (step S1505) (operational information storage unit), and determines whether or not the service person has chosen to log out the maintenance mode (step S1506).

As a result of the determination in the step S1506, when the service person has chosen to log out the maintenance mode, the CPU 201 causes the service person to log out the maintenance mode (step S1523) and terminates the present process.

As a result of the determination in the step S1506, when the service person has not chosen to log out the maintenance mode, the process returns to the step S1503.

As a result of the determination in the step S1502, when no error has occurred in the image forming apparatus 101, the CPU 201 determines which one is set as to the service person restriction setting 801, "ON (disable")", "OFF (enable)", or "OFF (authentication required)" (FIG. 6) (step S1511) (restricting unit).

Here, referring to FIG. 6, when the device administrator configures the service person operation restriction setting 801 at "ON (disable)" as shown by the information 811, the service person is allowed to refer to setting values of the user resource information 402 but is not allowed to change the setting values. As shown by the information 812, when the device administrator configures the service person operation restriction setting 801 at "OFF (enable)", the service person is allowed to refer to setting values of all the maintenance setting items 401 and change the setting values. As shown by the information 813, when the device administrator configures the service person operation restriction settings 801 at "OFF (authentication required)", the service person is allowed to refer to setting values in all the maintenance setting items 401 and change the setting values only when his or her login is authorized by the normal login authentication module 308.

Referring to FIG. 14B again, as a result of the determination in the step S1511, when the service person operation restriction setting 801 is configured at "OFF (authentication required)", the CPU 201 determines whether or not the service person has already been authenticated for login by the normal login authentication module 308 (step S1512) (user authentication unit).

As a result of the determination in the step S1512, when the service person has not yet been authenticated for login by the normal login authentication module 308, the CPU 201 displays the login authentication screen (FIG. 10) (step S1519) and determines whether or not the service person has been authorized to log in by the normal login authentication module 308 and has logged into a normal login mode (step S1520) (user authentication unit).

In the determination in the step S1520, for example, in the setting value change enable-disable determination result in FIG. 12, the "maintenance login authentication results" 902 for both the user A and the user B are "NG", and hence it is ascertained that they have no authority to manipulate the user resource information 402. For the user C, the "maintenance login authentication result" 902 is "OK" but the "authority (role)" 903 assigned in normal login authentication is "Guest", and it is thus ascertained that he or she has no authority to manipulate the user resource information 402.

On the other hand, for both the user D and the user E, the "maintenance login authentication results" 902 are "OK", and the "authorities (roles)" 903 are "General" and "Administrator", respectively. It is thus ascertained that they have the authority to manipulate the user resource information 402.

Referring to FIG. 14B again, as a result of the determination in the step S1512, when the service person has already been authenticated for login by the normal login authentication module 308, or as a result of the determination in the step S1520, when the service person has been authorized to log in by the normal login authentication module 308 and has logged into the normal login mode, the service person is allowed to change setting values of all the maintenance setting items 401, and hence the CPU 201 displays the maintenance settings 1310 to 1313 corresponding to all the maintenance setting items 401 on the maintenance screen 1300 and displays the OK buttons for the maintenance settings 1310 to 1313 on the maintenance screen 1300 (step S1513).

Then, the CPU 201 stores, in the HDD 204, the setting values of the respective maintenance setting items 401 changed using the display sections 1302 (step S1514), obtains setting value change enable-disable determination results (FIG. 12) managed by the authentication management module 306 (step S1515), stores operation record data (FIG. 13), which is created based on the stored setting values that have been changed and the obtained setting value change enable-disable determination results in the HDD 204 (step S1516) (operational information storage unit), and determines whether or not the service person has chosen to log out the maintenance mode (step 1517).

As a result of the determination in the step S1517, when the service person has chosen to log out the maintenance mode, the CPU 201 causes the service person to log out the normal login mode (step S1518) and further causes the service person to log out the maintenance mode (step S1523), and terminates the present process.

As a result of the determination in the step S1517, when the service person has not chosen to log out the maintenance mode, the process returns to the step S1513.

As a result of the determination in the step S1511, when the service person operation restriction setting 801 is configured at "ON (disable)", or as a result of the determination in the step S1520, when the service person has not been authorized to log in by the normal login authentication module 308 and is not allowed to log into the normal login mode, the service person is not allowed to change the setting values of the user resource information 402. Thus, on the maintenance screen 1300, but "-" is displayed for the maintenance setting items 1311 and 1312 corresponding to the user resource information 402 although the maintenance setting items 1310 to 1313 corresponding to all the maintenance setting items 401 are displayed (step S1521). On the other hand, setting values of the maintenance information 403 are allowed to be changed by the service person, and hence the OK buttons are displayed for the maintenance setting items 1310 and 1313 corresponding to the maintenance information 403.

Referring to FIG. 14B again, the CPU 201 determines whether or not the service person has chosen to log out the maintenance mode (step S1522).

As a result of the determination in the step S1522, when the service person has chosen to log out the maintenance mode, the CPU 201 causes the service person to log out the maintenance mode (step S1523) and terminates the present process.

As a result of the determination in the step S1522, when the service person has not chosen to log out the maintenance mode, the process returns to the step S1521.

As a result of the determination in the step S1511, when the service person operation restriction setting 801 is configured at "OFF (enable)", the service person is allowed to change setting values of all the maintenance setting items 401, and hence the CPU 201 displays the maintenance settings 1310 to 1313 corresponding to all the maintenance setting items 401 on the maintenance screen 1300 and displays the OK buttons for the maintenance settings 1310 to 1313 on the maintenance screen 1300 (step S1507).

Then, the CPU 201 stores the setting values of the respective maintenance setting items 401 changed using the display sections 1302 in the HDD 204 (step S1508), stores operation record data, which is created based on the stored setting values that have been changed, in the HDD 204 (step S1509) (operational information storage unit), and determines whether or not the service person has chosen to log out the maintenance mode (step 1510).

As a result of the determination in the step S1510, when the service person has chosen to log out the maintenance mode, the CPU 201 causes the service person to log out the maintenance mode (step S1523) and terminates the present process.

As a result of the determination in the step S1510, when the service person has not chosen to log out the maintenance mode, the process returns to the step S1507.

According to the process in FIGS. 14A and 14B, when the service person operation restriction setting 801 is configured at "OFF (authentication required)" ("OFF (authentication required)" in the step S1511), and the service person has not been authorized to log in by the normal login authentication module 308 and is not allowed to log into the normal login mode (NO in the step S1520), "-" is displayed for the maintenance settings 1311 and 1312 corresponding to the user resource information 402 although the maintenance settings 1310 to 1313 corresponding to all the maintenance setting items 401 are displayed (step S1521). This prevents unauthorized manipulations of maintenance setting items by the service person.

According to the process in FIGS. 14A and 14B, when the service person operation restriction setting 801 is configured at "ON (disable)" ("OFF (disable)" in the step S1511), the maintenance settings 1310 to 1313 corresponding to all the maintenance setting items 401 are displayed on the maintenance screen 1300, but "-" is displayed on the maintenance screen 1300 for the maintenance settings 1311 and 1312 corresponding to the user resource information 402 (step S1521). This prevents unauthorized manipulations of maintenance setting items by the service person.

Moreover, according to the process in FIGS. 14A and 14B, when an error has occurred in the image forming apparatus 101 (YES in the step S1502), the maintenance settings 1310 to 1313 corresponding to all the maintenance setting items 401 are displayed on the maintenance screen 1300, and the OK buttons are displayed on the maintenance screen 1300 with respect to only the maintenance settings 1310 and 1313 corresponding to the recovery items (4020 and 4030) required for recovery from the error among all the maintenance settings 1310 to 1313 (step S1503). This prevents unauthorized manipulations of maintenance setting items by the service person.

Further, according to the process in FIGS. 14A and 14B, since operation record data (FIG. 13) created based on information on setting values for operations changed using the display sections 1302 is stored in the HDD 204 (steps S1505, S1509, and S1516), the device administrator can manage manipulations of maintenance setting items by the service person.

Figure 16A:
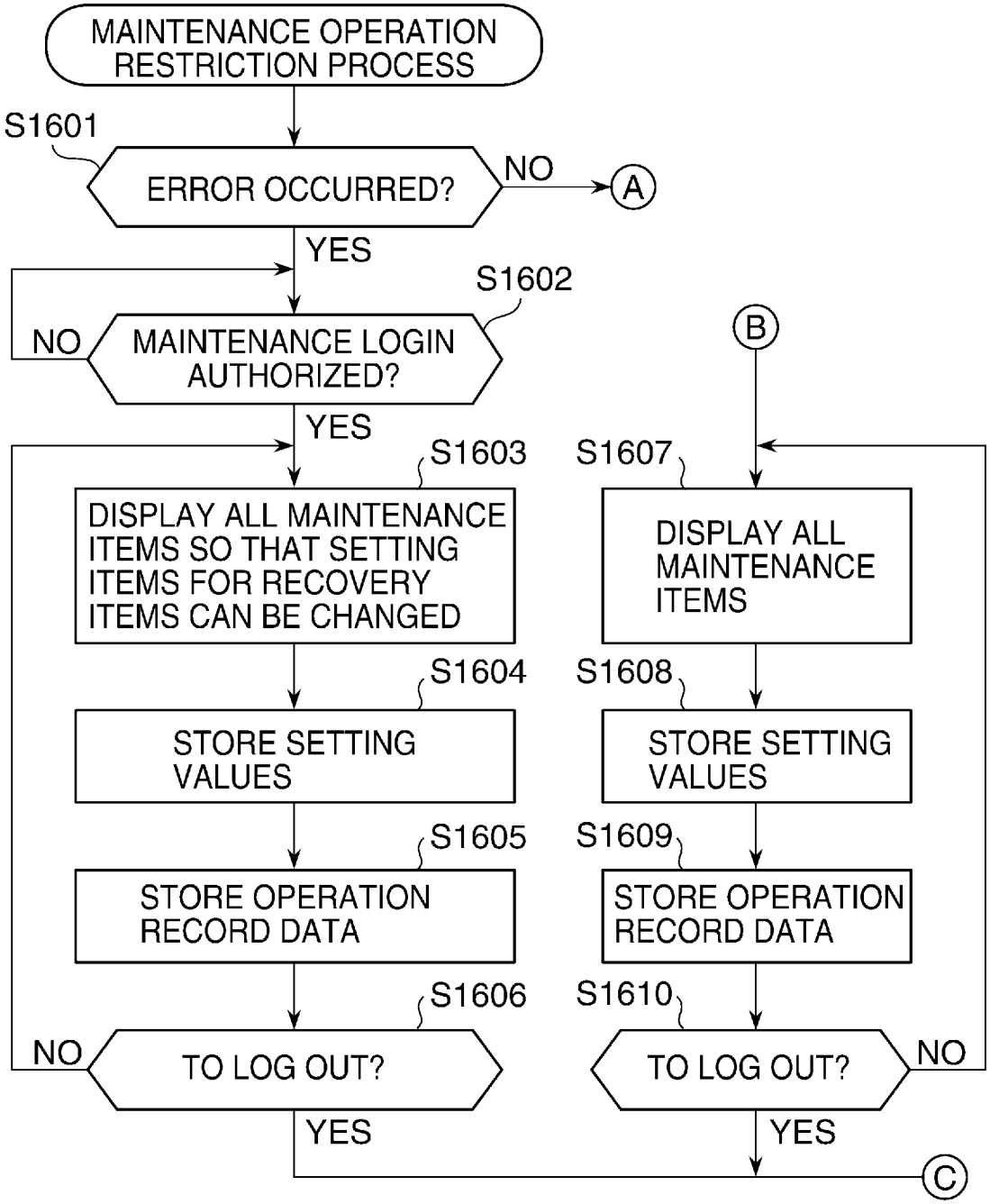
FIGS. 16A and 16B are flowcharts showing the procedure of a variation of the maintenance operation restricting process in FIGS. 14A and 14B.
Figure 16B:
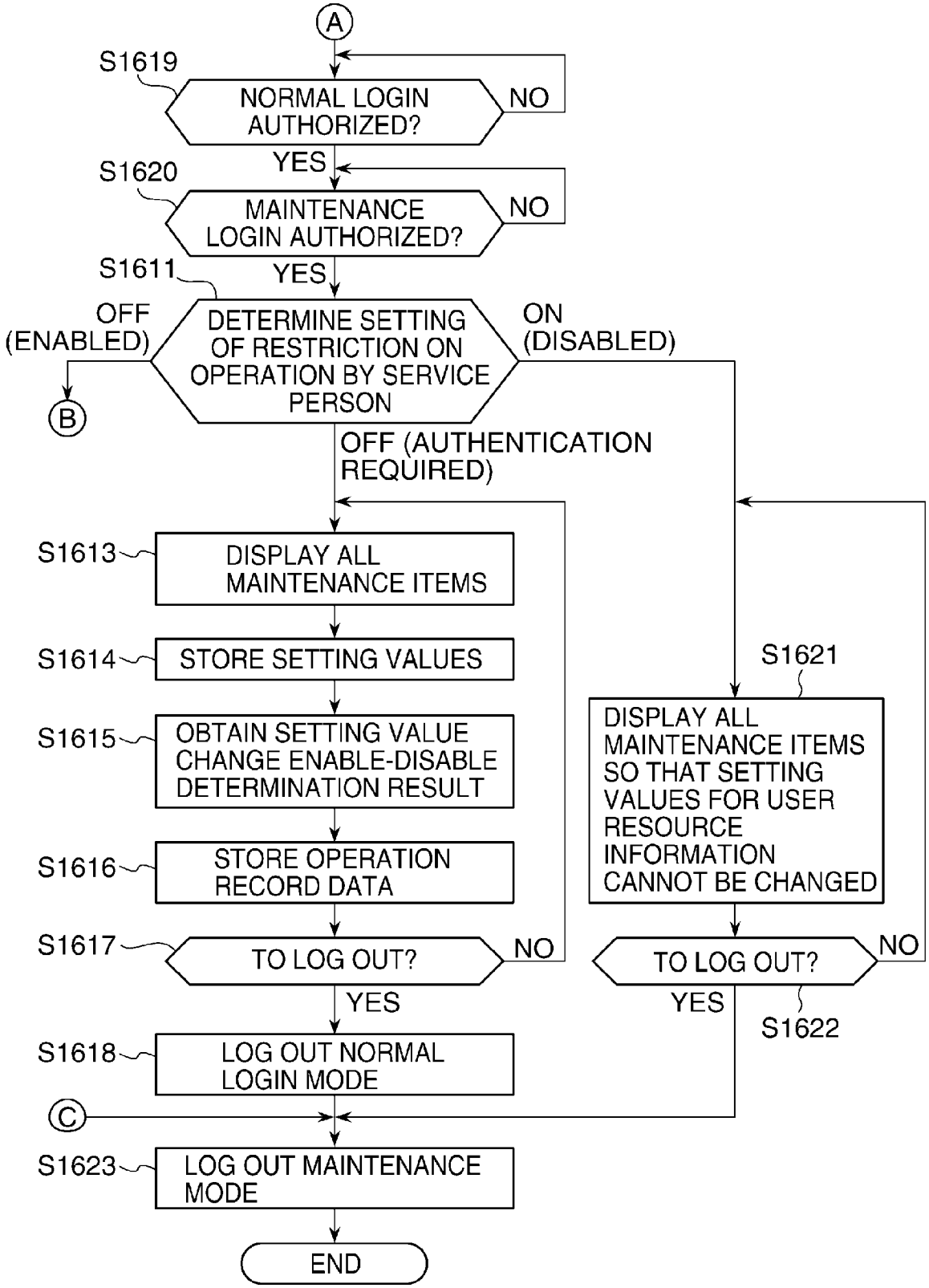

FIGS. 16A and 16B are flowcharts showing the procedure of a variation of the maintenance operation restriction process in FIGS. 14A and 14B.

The maintenance operation restriction process in FIGS. 16A and 16B is carried out by the CPU 201 executing software stored in the ROM 202 or the HDD 204 and differs from the maintenance operation restriction process in FIGS. 14A and 14B mainly in the order in which login authentication by the maintenance login authentication module 307 and determination as to whether or not an error has occurred in the image forming apparatus 101 are performed.

Referring to FIGS. 16A and 16B, first, the CPU 201 determines whether or not an error has occurred in the image forming apparatus 101 (step S1601) (determination unit).

As a result of the determination in the step S1601, when an error has occurred in the image forming apparatus 101, the CPU 201 displays the service person authentication screen (FIG. 8) on the operating unit 209, and next, when the service person is authorized to log in by the maintenance login authentication module 307 and logs into the maintenance mode (YES in step S1602) (maintenance authentication unit), the CPU 201 displays the maintenance settings 1310 to 1313 corresponding to all the maintenance setting items 401 on the maintenance screen 1300, and as for the maintenance settings 1310 and 1313 corresponding to the recovery items (4020 and 4030) required for recovery from the error among all the maintenance settings 1310 to 1313, displays the OK buttons on the maintenance screen 1300 (step S1603) (display control unit).

Then, as with the steps S1504 to S1523, the CPU 201 stores setting values for the operations in the respective recovery items (4020 and 4030) changed using the display sections 1302 in the HDD 204 (step S1604), stores operation record data (FIG. 13) created based on information on the stored setting values that have been changed in the HDD 204 (step S1605) (operational information storage unit), and determines whether or not the service person has chosen to log out the maintenance mode (step S1606).

As a result of the determination in the step S1606, when the service person has chosen to log out the maintenance mode, the CPU 201 causes the service person to log out the maintenance mode (step S1623) and terminates the process.

As a result of the determination in the step S1606, when the service person has not chosen to log out the maintenance mode, the process returns to the step S1603.

As a result of the determination in the step S1601, when no error has occurred in the image forming apparatus 101, the CPU 201 displays the login authentication screen (FIG. 10) on the operating unit 209, and the service person is authorized to log in by the normal login authentication module 308 and logs into the normal login mode (YES in the step S1619) (user authentication unit).

Then, the CPU 201 displays the service person authentication screen (FIG. 8), and when the service person is authorized to log in by the maintenance login authentication module 307 and logs into the maintenance mode (YES in step S1620) (maintenance authentication unit), the CPU 201 determines which one is set as to restriction on operation by the service person is configured at "ON (disable")", "OFF (enable)", or (OFF (authentication required)" (FIG. 6) as with the step S1511 (step S1611) (restricting unit).

As a result of the determination in the step S1611, when the service person operation restriction setting is configured at "OFF (authentication required)", the service person has already been authorized to log in by the normal login authentication module 308, and hence the service person is allowed to change setting values of all the maintenance setting items 401. Thus, the CPU 201 displays the maintenance settings 1310 to 1313 corresponding to all the maintenance setting items 401 on the maintenance screen 1300 and displays the OK buttons for the maintenance settings 1310 to 1313 on the maintenance screen 1300 (step S1613).

Then, as with the steps S1514 to S1523, the CPU 201 stores the setting values of the respective maintenance setting items 401 changed using the display sections 1302 in the HDD 204 (step S1614), obtains setting value change enable-disable determination results (FIG. 12) managed by the authentication management module 306 (step S1615), and stores operation record data (FIG. 13), which is created based on information on the stored setting values that have been changed and the obtained setting value change enable-disable determination results in the HDD 204 (step S1616) (operational information storage unit).

Then, the CPU 201 determines whether or not the service person has chosen to log out the maintenance mode (step S1617), and as a result of the determination in the step S1617, when the service person has chosen to log out the maintenance mode, the CPU 201 causes the service person to log out the normal login mode (step S1618) and further causes the service person to log out the maintenance mode (step S1623), and terminates the present process.

As a result of the determination in the step S1617, when the service person has not chosen to log out the maintenance mode, the process returns to the step S1613.

As a result of the determination in the step S1611, when the service person operation restriction setting 801 is configured at "ON (disable)", the service person is not allowed to change the setting values of the user resource information 402 as with the step S1521, and hence the CPU 201 displays "-" for the maintenance setting items 1311 and 1312 corresponding to the user resource information 402 although it displays, on the maintenance screen 1300, the maintenance setting items 1310 to 1313 corresponding to all the maintenance setting items 401 (step S1621).

Then, as with the steps S1522 and S1523, the CPU 201 determines whether or not the service person has chosen to log out the maintenance mode (step S1622), and as a result of the determination in the step S1622, when the service person has chosen to log out the maintenance mode, the CPU 201 causes the service person to log out the maintenance mode (step S1623) and terminates the present process.

As a result of the determination in the step S1622, when the service person has not chosen to log out the maintenance mode, the process returns to the step S1621.

As a result of the determination in the step S1611, when the service person operation restriction setting 801 is configured at "OFF (enable)", the service person is allowed to change setting values of all the maintenance setting items 401 as with the step S1507, and hence the CPU 201 displays the maintenance settings 1310 to 1313 corresponding to all the maintenance setting items 401 on the maintenance screen 1300 and displays the OK buttons for the maintenance settings 1310 to 1313 on the maintenance screen 1300 (step S1607).

Then, as with the steps S1508 to S1523, the CPU 201 stores the setting values of the respective maintenance setting items 401 changed using the display sections 1302 in the HDD 204 (step S1608) and stores operation record data, which is created based on the stored setting values that have been changed, in the HDD 204 (step S1609) (operational information storage unit).

Then, the CPU 201 determines whether or not the service person has chosen to log out the maintenance mode (step 1610), and as a result of the determination in the step S1610, when the service person has chosen to log out the maintenance mode, the CPU 201 causes the service person to log out the maintenance mode (step S1623) and terminates the present process.

As a result of the determination in the step S1610, when the service person has not chosen to log out the maintenance mode, the process returns to the step S1607.

According to the process in FIGS. 16A and 16B, the same effects as those in the process in FIGS. 14A and 14B described above can be obtained.

Although in the embodiments described above, the user resource information 402 and the maintenance information 403 in FIG. 5 are managed by numbers (Nos.), they may be managed by alphabets or the like. Also, in the user resource information 402 and the maintenance information 403, descriptions of operations other than operations written in the "item names" 502 in FIG. 5 may be held.

In the embodiments described above, the order in which the user resource information 402 and the maintenance information 403 are displayed may be varied according to types, and they may be displayed in such an order that the service person can perform maintenance work with ease.

Although in the embodiments described above, only one type of service person password is held as shown in FIG. 9, a plurality of passwords may be held.

In the embodiments described above, operation record data in FIG. 13 may have information about which setting values for respective operations have been changed to which setting values. Also, operation record data on the maintenance information 403 should not always have information on the user names 1001.

In the embodiments described above, even when an operation is such that the "item to be logged" 503 in FIG. 5 is "o", operation record data in FIG. 13 may not be stored depending on an error condition of the image forming apparatus 101.

In the embodiments described above, "-" is displayed on the service person maintenance screen 1300 with respect to operations for which setting values are not allowed to be changed, setting values being not allowed to be changed may be indicated by not displaying the OK buttons 1303 themselves. Also, as for maintenance settings for which "-" is displayed on the service person maintenance screen 1300, setting values for operations may be changed with conditions by the service person, and operation record data (FIG. 13) on the setting values thus changed may be stored in the HDD 204.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-012534, filed Jan. 27, 2014, which is hereby incorporated by reference herein in its entirety.

What is claimed is:

1. An image forming apparatus comprising:

a setting item storage unit configured to store a plurality of setting items having setting values that are changed by maintenance work on the image forming apparatus;

a maintenance authentication unit configured to authenticate a maintenance worker who performs the maintenance work on the image forming apparatus;

a restricting unit configured to restrict change of the setting values by the authenticated maintenance worker;

a user authentication unit configured to authenticate a user who uses the image forming apparatus; and a display control unit configured to, when said restricting unit restricts change of the setting values by the maintenance worker, control display of the plurality of setting items on a basis of whether or not the maintenance worker has been authenticated by said user authentication unit.

2. The image forming apparatus according to claim 1, wherein in a case where the maintenance worker has not been authenticated by said user authentication unit, said display control unit indicates that the setting values are not allowed to be changed when displaying the plurality of setting items and the setting values of the setting items.

3. The image forming apparatus according to claim 1, wherein in a case where said restricting unit restricts change of the setting values by the maintenance worker, said display control unit indicates that the setting values of which change is restricted are not allowed to be changed when displaying the plurality of setting items and the setting values of the setting items.

4. The image forming apparatus according to claim 1, further comprising:

an identifying unit configured to identify setting items required for maintenance work in recovery from an error in the image forming apparatus among the plurality of setting items; and a determination unit configured to determine whether the error has occurred in the image forming apparatus, wherein, when the error has occurred in the image forming apparatus, said display control unit indicates that the maintenance worker authenticated by said maintenance authentication unit is allowed to change setting values of the identified setting items when displaying the plurality of setting items and the setting values of the setting items.

5. The image forming apparatus according to claim 4, wherein, when the error has occurred in the image forming apparatus, said display control unit indicates that setting values of setting items other than the identified setting items among the plurality of setting items are not allowed to be changed when displaying the plurality of setting items and the setting values of the setting items.

6. The image forming apparatus according to claim 1, further comprising an operational information storage unit configured to store operational information based on the changed setting values.

7. A control method for an image forming apparatus, the method comprising:

a setting item storage step of storing a plurality of setting items having setting values that are changed by maintenance work on the image forming apparatus;

a maintenance authentication step of authenticating a maintenance worker who performs the maintenance work on the image forming apparatus;

a restricting step of restricting change of the setting values by the authenticated maintenance worker;

a user authentication step of authenticating a user who uses the image forming apparatus; and a display control step of, when change of the setting values by the maintenance worker is restricted in said restricting step, controlling display of the plurality of setting items on a basis of whether or not the maintenance worker has been authenticated in said user authentication step.

8. A non-transitory computer-readable storage medium storing a program executable by a computer to implement a control method for an image forming apparatus, the control method comprising:

a setting item storage step of storing a plurality of setting items having setting values that are changed by maintenance work on the image forming apparatus;

a maintenance authentication step of authenticating a maintenance worker who performs the maintenance work on the image forming apparatus;

a restricting step of restricting change of the setting values by the authenticated maintenance worker;

a user authentication step of authenticating a user who uses the image forming apparatus; and a display control step of, when change of the setting values by the maintenance worker is restricted in said restricting step, controlling display of the plurality of setting items on a basis of whether or not the maintenance worker has been authenticated in said user authentication step.

9. An image forming apparatus for allowing a maintenance worker to perform maintenance work on the image forming apparatus, the image forming apparatus comprising:

a first receiving unit configured to receive a predetermined operation performed by the maintenance worker, the predetermined operation being an operation for shifting a state of the image forming apparatus into a state in which the maintenance worker is able to perform one or more maintenance works;

a second receiving unit configured to receive input of a password;

a control unit configured to:

in a case where said first receiving unit receives the predetermined operation and said second receiving unit does not receive input of the password:

disable a first maintenance work that deletes predetermined data that a user has an authority to manipulate and is stored in the image forming apparatus; and enable a second maintenance work that does not delete the predetermined data; and in a case where said first receiving unit receives the predetermined operation and said second receiving unit receives input of the password, enable both the first maintenance work and the second maintenance work.

10. The image forming apparatus according to claim 9, further comprising:

a setting unit configured to configure setting for enabling execution of the first maintenance work by the maintenance worker only when the password is input according to an instruction from a system administrator different from the maintenance worker, wherein when the setting is configured by said setting unit, said control unit provides the control.

11. The image forming apparatus according to claim 9, further comprising:

a setting unit configured to configure setting for enabling execution of the first maintenance work by the maintenance worker regardless of input of the password, wherein in a case where the setting is configured by said setting unit, said control unit enables execution of maintenance work involving access to the predetermined data by the maintenance worker regardless of whether said second receiving unit receives input of the password.

12. The image forming apparatus according to claim 9, further comprising:

a setting unit configured to configure setting for disabling execution of the first maintenance work by the maintenance worker regardless of input of the password, wherein in a case where the setting is configured by said setting unit, said control unit disables execution of maintenance work involving access to the predetermined data by the maintenance worker regardless of whether said second receiving unit receives input of the password.

13. The image forming apparatus according to claim 9, further comprising:

a detection unit configured to detect an error occurred in the image forming apparatus, wherein in a case where said detection unit detects the error, said control unit enables execution of maintenance work involving access to the predetermined data regardless of whether said second receiving unit receives input of the password.

14. The image forming apparatus according to claim 9, wherein said control unit disables execution of maintenance work involving access to the predetermined data by the maintenance worker by disabling change in a setting value relating to a setting item for the first maintenance work.

15. The image forming apparatus according to claim 9, wherein said control unit disables execution of maintenance work involving access to the predetermined data by the maintenance worker by hiding a setting value relating to a setting item for the first maintenance work.

16. The image forming apparatus according to claim 9, wherein the first maintenance work is for deleting a password of a system administrator.

17. The image forming apparatus according to claim 9, wherein the first maintenance work is for deleting an application cache.

18. The image forming apparatus according to claim 9, wherein the first maintenance work is for initializing the image forming apparatus.

19. The image forming apparatus according to claim 9, wherein the second maintenance work relates to setting for a size of a sheet tray.

20. The image forming apparatus according to claim 9, wherein the second maintenance work is for clearing a service counter.

21. The image forming apparatus according to claim 9, wherein the second maintenance work is for image adjustment.

22. The image forming apparatus according to claim 9, further comprising an authentication unit configured to perform authentication using the password received by said second receiving unit, wherein said control unit is configured to:

in a case where said first receiving unit receives the predetermined operation and said authentication unit fails to perform the authentication using the password received by said second receiving unit, disable the first maintenance work and enable the second maintenance work; and in a case where said first receiving unit receives the predetermined operation and said authentication unit succeeds to perform the authentication using the password received by said second receiving unit, enable both the first maintenance work and the second maintenance work.

23. The image forming apparatus according to claim 9, wherein the predetermined operation is an operation to log into a maintenance mode.

24. A control method for an image forming apparatus for allowing a maintenance worker to perform maintenance work on the image forming apparatus, the method comprising:

a first receiving step of receiving a predetermined operation performed by the maintenance worker, the predetermined operation being an operation for shifting a state of the image forming apparatus into a state in which the maintenance worker is able to perform one or more maintenance works;

a second receiving step of receiving input of a password;

a control step of:

in a case where the predetermined operation is received in said first receiving step and input of the password is not received in said second receiving step:

disabling a first maintenance work that deletes predetermined data that a user has an authority to manipulate and is stored in the image forming apparatus; and enabling a second maintenance work that does not delete the predetermined data; and in a case where the predetermined operation is received in said first receiving step and input of the password is received in said second receiving step, enabling both the first maintenance work and the second maintenance work.

25. A non-transitory computer-readable storage medium storing a program executable by a computer to implement a control method for an image forming apparatus for allowing a maintenance worker to perform maintenance work on the image forming apparatus, the control method comprising:

a first receiving step of receiving a predetermined operation performed by the maintenance worker, the predetermined operation being an operation for shifting a state of the image forming apparatus into a state in which the maintenance worker is able to perform one or more maintenance works;

a second receiving step of receiving input of a password;

a control step of:

in a case where the predetermined operation is received in said first receiving step and input of the password is not received in said second receiving step:

disabling a first maintenance work that deletes predetermined data that a user has an authority to manipulate and is stored in the image forming apparatus; and enabling a second maintenance work that does not delete the predetermined data; and in a case where the predetermined operation is received in said first receiving step and input of the password is received in said second receiving step, enabling both the first maintenance work and the second maintenance work.

26. An image forming apparatus for allowing a maintenance worker to perform maintenance work on the image forming apparatus, the image forming apparatus comprising:

a first receiving unit configured to receive a predetermined operation performed by the maintenance worker, the predetermined operation being an operation for shifting a state of the image forming apparatus into a state in which the maintenance worker is able to perform one or more maintenance works;

a second receiving unit configured to receive input of a password;

a control unit configured to perform, based on a reception of the predetermined operation and authentication using the password received by said second receiving unit being unsuccessful, a control such that a first maintenance work that deletes predetermined data stored in the image forming apparatus is disabled and a second maintenance work that does not delete the predetermined data is enabled.

27. The image forming apparatus according to claim 26, further comprising an authentication unit configured to perform authentication using the password received by said second receiving unit, wherein said control unit is configured to:

in a case where said first receiving unit receives the predetermined operation and said authentication unit fails to perform the authentication using the password received by said second receiving unit, disable the first maintenance work and enable the second maintenance work; and in a case where said first receiving unit receives the predetermined operation and said authentication unit succeeds to perform the authentication using the password received by said second receiving unit, enable both the first maintenance work and the second maintenance work.

28. The image forming apparatus according to claim 26, wherein the predetermined operation is an operation to log into a maintenance mode.

29. A control method for an image forming apparatus for allowing a maintenance worker to perform maintenance work on the image forming apparatus, the method comprising:

a first receiving step of receiving a predetermined operation performed by the maintenance worker, the predetermined operation being an operation for shifting a state of the image forming apparatus into a state in which the maintenance worker is able to perform one or more maintenance works;

a second receiving step of receiving input of a password;

a control step of performing, based on a reception of the predetermined operation in said first receiving step and authentication using the password received in said second receiving step being unsuccessful, a control such that a first maintenance work that deletes predetermined data that a user has an authority to manipulate and is stored in the image forming apparatus is disabled and a second maintenance work that does not delete the predetermined data is enabled.

30. A non-transitory computer-readable storage medium storing a program executable by a computer to implement a control method for an image forming apparatus for allowing a maintenance worker to perform maintenance work on the image forming apparatus, the control method comprising:

a first receiving step of receiving a predetermined operation performed by the maintenance worker, the predetermined operation being an operation for shifting a state of the image forming apparatus into a state in which the maintenance worker is able to perform one or more maintenance works;

a second receiving step of receiving input of a password;

a control step of performing, based on a reception of the predetermined operation in said first receiving step and authentication using the password received in said second receiving step being unsuccessful, a control such that a first maintenance work that deletes predetermined data that a user has an authority to manipulate and is stored in the image forming apparatus is disabled and a second maintenance work that does not delete the predetermined data is enabled.

* * * * *